US011261409B2

(12) United States Patent
Naqvi

(10) Patent No.: US 11,261,409 B2
(45) Date of Patent: Mar. 1, 2022

(54) TABLET PRODUCTION

(71) Applicant: One Home Brands, Inc., New York, NY (US)

(72) Inventor: Syed Humza Naqvi, Walnut Creek, CA (US)

(73) Assignee: One Home Brands, Inc., New York, NY (US)

( * ) Notice: Subject to any disclaimer, the term of this patent is extended or adjusted under 35 U.S.C. 154(b) by 33 days.

(21) Appl. No.: 16/850,953

(22) Filed: Apr. 16, 2020

(65) Prior Publication Data

US 2020/0332234 A1 Oct. 22, 2020

Related U.S. Application Data

(60) Provisional application No. 62/836,368, filed on Apr. 19, 2019.

(51) Int. Cl.

| | |
|---|---|
| ***C11D 17/00*** | (2006.01) |
| ***C11D 3/10*** | (2006.01) |
| ***C11D 3/20*** | (2006.01) |
| ***C11D 3/08*** | (2006.01) |

(52) U.S. Cl.

CPC ..... *C11D 17/0073* (2013.01); *C11D 3/08* (2013.01); *C11D 3/10* (2013.01); *C11D 3/202* (2013.01)

(58) Field of Classification Search

None

See application file for complete search history.

(56) References Cited

U.S. PATENT DOCUMENTS

| | | | | |
|---|---|---|---|---|
| 5,691,293 | A * | 11/1997 | Kruse | C11D 1/667 510/224 |
| 6,190,697 | B1 * | 2/2001 | Gergely | A61K 36/00 424/466 |
| 6,380,147 | B1 * | 4/2002 | Speckmann | C11D 3/386 435/202 |
| 2002/0122775 | A1 * | 9/2002 | Reinhardt | A61K 8/4926 424/49 |
| 2008/0299198 | A1 | 12/2008 | Ho et al. | |
| 2015/0216887 | A1 * | 8/2015 | Derrieu | A23K 20/174 514/30 |

FOREIGN PATENT DOCUMENTS

| | | | |
|---|---|---|---|
| EP | 0799886 | A2 | 10/1997 |
| EP | 3299446 | A1 | 3/2018 |
| WO | 2008-030512 | A2 | 3/2008 |
| WO | WO 2015/054564 | A1 * | 4/2015 |

OTHER PUBLICATIONS

International Search Report and Written Opinion dated Jul. 31, 2020 in International Application No. PCT/US2020/028686.

Office Action issued in DE Application No. 10 2020 002 380.0, dated Sep. 6, 2021 w/English Translation.

* cited by examiner

*Primary Examiner* — Lorna M Douyon

(74) *Attorney, Agent, or Firm* — McDermott Will & Emery LLP; James M. Oehler

(57) ABSTRACT

The invention relates to stable, anhydrous concentrated formulations in tablet form and methods of making stable, anhydrous concentrated formulation tablets.

14 Claims, 9 Drawing Sheets

TABLET PRODUCTION

CROSS REFERENCE TO RELATED APPLICATIONS

This application claims priority to U.S. Provisional Application No. 62/836,368, filed Apr. 19, 2019, the entire contents of which are incorporated herein for reference.

BACKGROUND

The majority of cleaning products on the market are in liquid or gel forms and packaged in a plastic tube, bottle, spray bottle, or pump dispenser. The problem is the packaging. Single use plastic is everywhere and it is wreaking havoc on the environment. Only 9% of all plastic is actually recycled, and packaging generates the largest portion of municipal waste (~30%). Packaged products are inefficient for businesses and the people who buy them.

Removing the water from cleaning formulations removes the need for single use plastic packaging and the waste that comes with it, such as packaging waste, product waste, and the waste of resources used to ship water.

Thus, a need exists for new stable formulations of cleansers meet the needs of consumers, while also reducing the amount of waste generated in their production and shipping.

SUMMARY

The application relates to stable, anhydrous cleanser concentrate formulations. The stable anhydrous cleanser concentrate formulations may be in a solid form such as a tablet. The solid stable anhydrous cleanser concentrate formulations comprise an acidic cleaner, a pH control agent which can be a basic cleaner, and an oily soil remover (a surfactant).

In one aspect, a method of producing an anhydrous tablet includes the steps of providing medium-chain triglyceride (MCT) oil; adding the MCT oil to a basic cleaner powder and a surfactant powder; absorbing the MCT oil into the basic cleaner powder and the surfactant powder to produce a powder blend; placing the powder blend in a tablet press; applying pressure to the powder blend in the tablet press; removing at least a portion of the MCT oil from the powder blend in the tablet press; using the portion of the MCT oil removed from the powder blend to create a hydrophobic layer on at least a portion of the exterior of the powder blend; removing pressure applied to the powder blend by the tablet press; and producing an anhydrous tablet from the pressed powder blend.

The method of producing an anhydrous tablet may include the step of adding additional ingredients to the powder blend after the MCT oil is absorbed into the basic cleaner powder and the surfactant powder.

In one aspect of the method of producing an anhydrous tablet, a portion of the MCT oil removed from the powder blend in the tablet press is removed by the pressure applied by the tablet press to the powder blend.

In one aspect of the method of producing an anhydrous tablet, the powder blend is not stuck to the tablet press after pressure is removed from the powder blend.

In one aspect of the method of producing an anhydrous tablet, the hydrophobic layer prevents the powder blend from sticking to the tablet press.

In one aspect of the method of producing an anhydrous tablet, the concentration of MCT oil is 0.05-1.00 wt %.

The method of producing an anhydrous tablet may include the step of adding fragrance to the powder blend.

The method of producing an anhydrous tablet may include the step of adding the MCT oil to a silica powder and absorbing the MCT oil into the silica powder.

In one aspect of the method of producing an anhydrous tablet, the MCT oil comprises MCT oil, fragrance, emulsifier, and/or dye.

In one aspect of the method of producing an anhydrous tablet, at least 70 kN of force is applied to the powder blend by the tablet press.

In one aspect of the method of producing an anhydrous tablet, a dimension of the tablet is smaller than an industry standard bottle opening.

In one aspect of the method of producing an anhydrous tablet, a dimension of the tablet is smaller than 28 millimeters.

In one aspect of the method of producing an anhydrous tablet, a dimension of the tablet is less than 0.75 inches.

In one aspect of the method of producing an anhydrous tablet, the ingredients of the tablet are not granulated prior to tablet production.

In one aspect of the method of producing an anhydrous tablet, the basic cleaner is selected from sodium carbonate, sodium bicarbonate and other alkali carbonates.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings.

Figure 1:
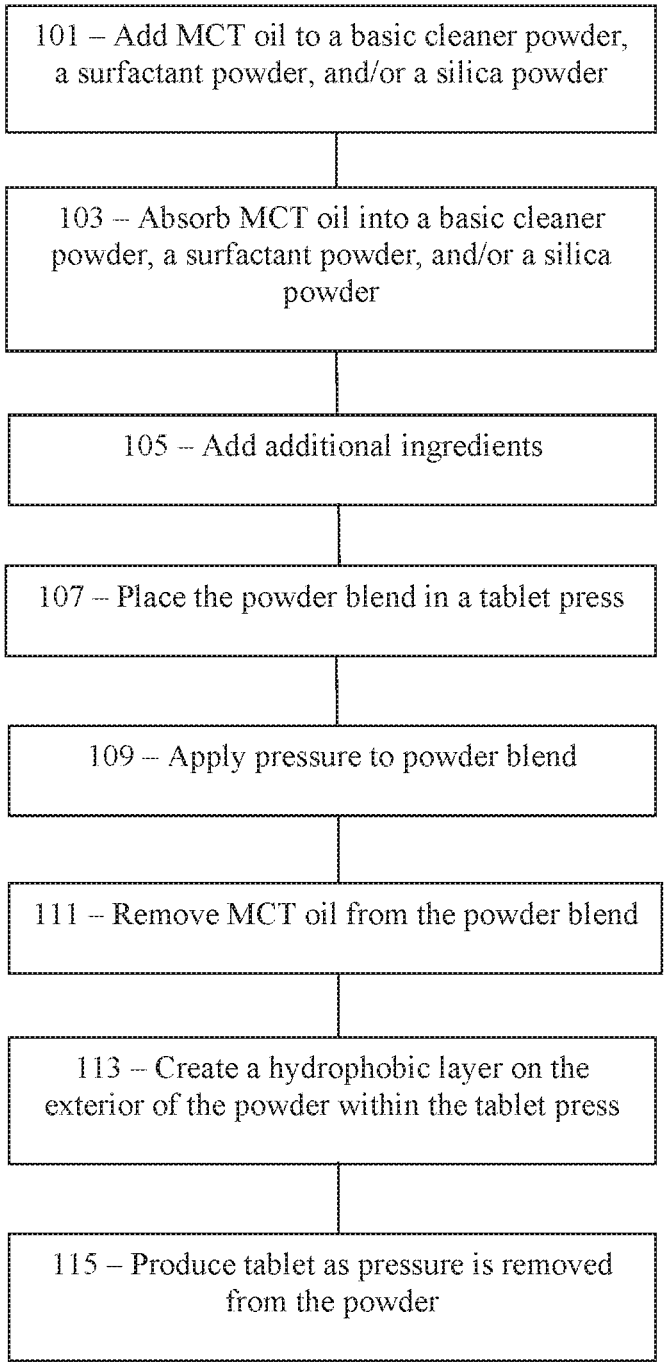
FIG. 1 illustrates a method of producing an anhydrous tablet according to certain aspects of the disclosure.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

In addition, each of the drawings is a schematic diagram and thus is not necessarily strictly illustrated. In each of the drawings, substantially the same structural components are assigned with the same reference signs, and redundant descriptions will be omitted or simplified.

DETAILED DESCRIPTION OF THE INVENTION

The detailed description set forth below is intended as a description of various implementations and is not intended to represent the only implementations in which the subject technology may be practiced. As those skilled in the art would realize, the described implementations may be modified in various different ways, all without departing from the scope of the present disclosure. For example, while the tablet production discussed herein may be implemented in many different forms, the disclosure will show in the drawings, and will herein describe in detail, implementations with the understanding that the present description is to be considered as an exemplification of the principles of the tablet production and is not intended to limit the broad aspects of the disclosure to the implementations illustrated. Accordingly, the drawings and description are to be regarded as illustrative in nature and not restrictive.

This disclosure relates to a method of producing a solid stable anhydrous concentrate, such as a cleanser concentrate, in tablet form. The inventors have discovered solid formulations that are both good for the environment and effective for cleaning purposes. The advantages of these solid formulation over the traditional liquid cleansers include chemical stability, reduced packaging, and convenience for the consumer. The tablets and production methods may be used with a variety of concentrates, such as, for example, a bathroom cleaner, a multi-surface cleaner, a glass cleaner, a hand soap, a laundry detergent, or a dish soap. Exemplary embodiments of the tablets are listed below.

The tablets may be produced using a direct compression process. Direct compression (or direct compaction) is the process by which tablets are compressed directly from a powdered substance and suitable excipients into a firm compact tablet without employing the process of granulation.

Powdered ingredients may be blended homogeneously using a blender, such as a ribbon blender, V-blender, paddle blender, or drum mixing. The blended powder may be then fed into the hopper of a tablet press. An example tablet press is a Stokes model DS3, 15 station press with a keyed turret. A desired amount of the powder may be placed into a die of the tablet press. The desired amount may be determined by volume or weight, for example. The powder is compressed within the die, such as by applying pressure to the powder with one or more punches, such as an upper punch and a lower punch. The force of compression combines the powdered ingredients into a solid tablet. The desired compression pressure, weight of tablet, and hardness of tablet may be set before or as the tablets get compressed. In some embodiments, the desired hardness of tablet may be greater than 18 kpa.

Proper tablet production requires balancing three purposes: (i) maintaining the desired shape and dimensions of the tablet, (ii) minimizing a dimension of the tablet, such as the thickness, and (iii) including all the necessary ingredients in the tablet while allowing for efficient tablet production.

Maintaining the desired shape and dimensions of the tablet is required to ensure that the tablet can easily be passed through an industry standard bottle opening and neck. An industry standard bottle opening and neck size may be, for example, 28 millimeters. As stated in more detail below, some tablets, such as those for a cleaning solution, may be placed within a bottle filled with water in order to dissolve the tablet in water to create the cleaning solution. Ensuring that the tablet easily passes through an industry standard bottle opening and neck allows the use of industry standard bottles and caps and avoids the need for custom tooling, which lowers the cost and improves the efficiency of using the resulting cleaning solution. Further, using industry standard bottles and caps allows the use of industry standard threading that has established strength and integrity. Maintaining a shape and dimensions that easily allow the end user to insert the tablet in a bottle without significant effort may result in a more pleasant and more tidy experience for the end user with less splashing.

The bulk density of the powdered ingredients may be between 0.65-0.95 grams per cubic centimeter, for example. Such a value of bulk density may allow each tablet to be the required weight and desired shape to pass through an industry standard bottle opening and neck. If the bulk density is too low, the tablets may not be the required weight and/or shape, depending on the limitations of the tablet press.

Minimizing a dimension of the tablet, such as the thickness, may allow the tablet to fit within packages or envelopes that can be delivered through relatively low cost shipping methods, such as postal services. For example, producing a tablet with a dimension that is less than 0.75 inches may allow the tablet to be shipped in a standard United States Postal Service flat mail package, which has relatively low shipping costs. Allowing for low cost delivery of the tablets is important for businesses that sell products through e-commerce and ship products directly to consumers, as opposed to businesses that sell products in brick-and-mortar stores, because the volume of products shipped with e-commerce businesses is much higher.

Including all the necessary ingredients in the tablet while allowing for efficient tablet production is challenging because certain ingredients may cause the powdered ingredients to stick to parts of the tablet press during production. Ingredients for exemplary tablets are included below. For example, concentrations of surfactant ingredients greater than about 5 weight %, such as 5-25%, may cause the tablet to stick during production. As a second example, including fragrance ingredients greater than about 0.5 weight %, such as 0.5-2%, may cause the tablet to stick during production. Sticking occurs when portions of the powdered ingredients attach and stick to the faces of the punches instead of locking together to create the tablet. Sticking results in overall inefficient tablet production due to defective tablets and machine delays. The defective tablets must be discarded and stuck material on the tablet press requires stopping production to clean the tablet press.

In one aspect of this disclosure, adding a medium-chain triglyceride (MCT) oil to the powder formulation may prevent the powdered ingredients from attaching and sticking to the faces of the punches and/or die during tablet production. MCT Oil is a caprylic capric triglyceride and its Chemical Abstracts Service (CAS) Registry Number is 65381-09-1. Suitable examples of MCT oil may include Acme Hardesty MCT Oil 3585/3595, Columbus Foods MCT 585, and Stepan Neobee 1053. The MCT oil may comprise about 0.05-1.00 weight % of the powder formulation to prevent sticking.

As shown in FIG. 1, step 101, the MCT oil may be added to the formulation by adding (such as through spraying) the MCT oil to a basic cleaner powder, such as sodium carbonate for example, or a surfactant powder, or a silica powder. Additionally or alternatively, the MCT oil may be added to the formulation by spraying the MCT oil on a combination of any of a basic cleaner powder, a surfactant powder, and/or a silica powder. In step 103, the MCT oil may be absorbed into the powder and/or powder blend. In step 105, additional ingredients may be added after the MCT oil is absorbed.

Additionally or alternatively, the MCT oil may include other ingredients, such as fragrance, emulsifiers, or dyes, for example.

In step 107, the powder blend with the absorbed MCT oil may be placed in the tablet press to form the tablet through compression. In steps 109 and 111, as the powder blend with the absorbed MCT oil is compressed, MCT oil may be pressed out of the powder. Forces of about 7 tons (70 kN) or higher, for example, may be required to press the MCT oil out of the powder. Applying a force less than 7 tons may not cause sufficient MCT oil to come out of the powder to prevent powdered ingredients from sticking to the faces of the punches and/or die during tablet production. Additionally or alternatively, increasing the force from a lower amount to about 7 tons or more may clean residual powder that is stuck on the tablet press.

In steps 113, the MCT oil may create a hydrophobic layer on the exterior of the powder within the tablet press. The hydrophobic layer may prevent the powder from sticking to the tablet press during tablet production. The hydrophobic layer may be created on some portion of the exterior of the powder or on the entire exterior. In step 115, the tablet is produced as the pressure is removed from the powder blend.

In some embodiments, such as a dish soap for example, the method of producing the tablets includes blending a first set of the ingredients of the soap formulation, adding a second set of the ingredients, and blending the first and second set of the ingredients. In some embodiments, the method of producing the tablets includes blending a first set of the ingredients of the soap formulation, adding a second set of the ingredients, blending the first and second set of the ingredients, adding a flow aid, and blending the first and second set of the ingredients and the flow aid. In some embodiments, for example, the first set of the ingredients include a filler and a water softening agent, the second set of the ingredients comprise a surfactant, an enzyme, and a water softening agent.

Exemplary steps to produce a dish soap tablet with direct compression may include:

a) Add sodium carbonate, sodium citrate*, and sodium silicate* to a blender (*these ingredients can be added now or after step "b").
b) Start blender and add/spray/pour sorbitan caprylate onto the mixture from step "a".
c) Mix for 4 minutes.
d) While blending or stopped, add next ingredients set: subtilisin (protease), sodium carboxymethyl inulin, lauryl/myristyl glucoside, amylase, sorbitol, citric acid anhydrous.
e) Mix for 4 minutes after last ingredient is added.
f) Add hydrated silica mix for 1 minute and stop blender.
g) Charge the hopper of a tablet press with the powder blend from step "f".
h) Set the tablet press machine to medium-high press.
i) Run a small number of sample tablets and set the weight to between 8.7-9.3 grams/tablet.
j) Apply pressure and set the weight as adjustments are made.
k) Check the hardness of the tablet to ensure it is greater than 5 kpa, for example
   A hand method can also be used to check the hardness if tablet hardness meter is not available. For the hand method, take a tablet and break it in the center by holding the tablet between an index finder and a thumb on one side and index finger and thumb on other side. If the tablet breaks with ease, increase the tablet press pressure. Apply tablet press pressure until the tablet is hard enough to not break easily at the center.
l) Place completed tablets in packaging, such as compostable pouches.

When the solid stable anhydrous concentrate formulation is in the form of a tablet, the tablets may range in size from about 200 mg to about 9000 mg or from about 200 mg to 5000 mg. The tablets may be about 200 mg, about 300 mg, about 400 mg, about 500 mg, about 600 mg, about 700 mg, about 800 mg, about 900 mg, or about 1000 mg. In a preferred embodiment, the tablets are round or oblong, however other geometric shapes are contemplated. The anhydrous tablets may include an amount of liquid, such as 5-10% or preferably 6.5%.

Figure 2:
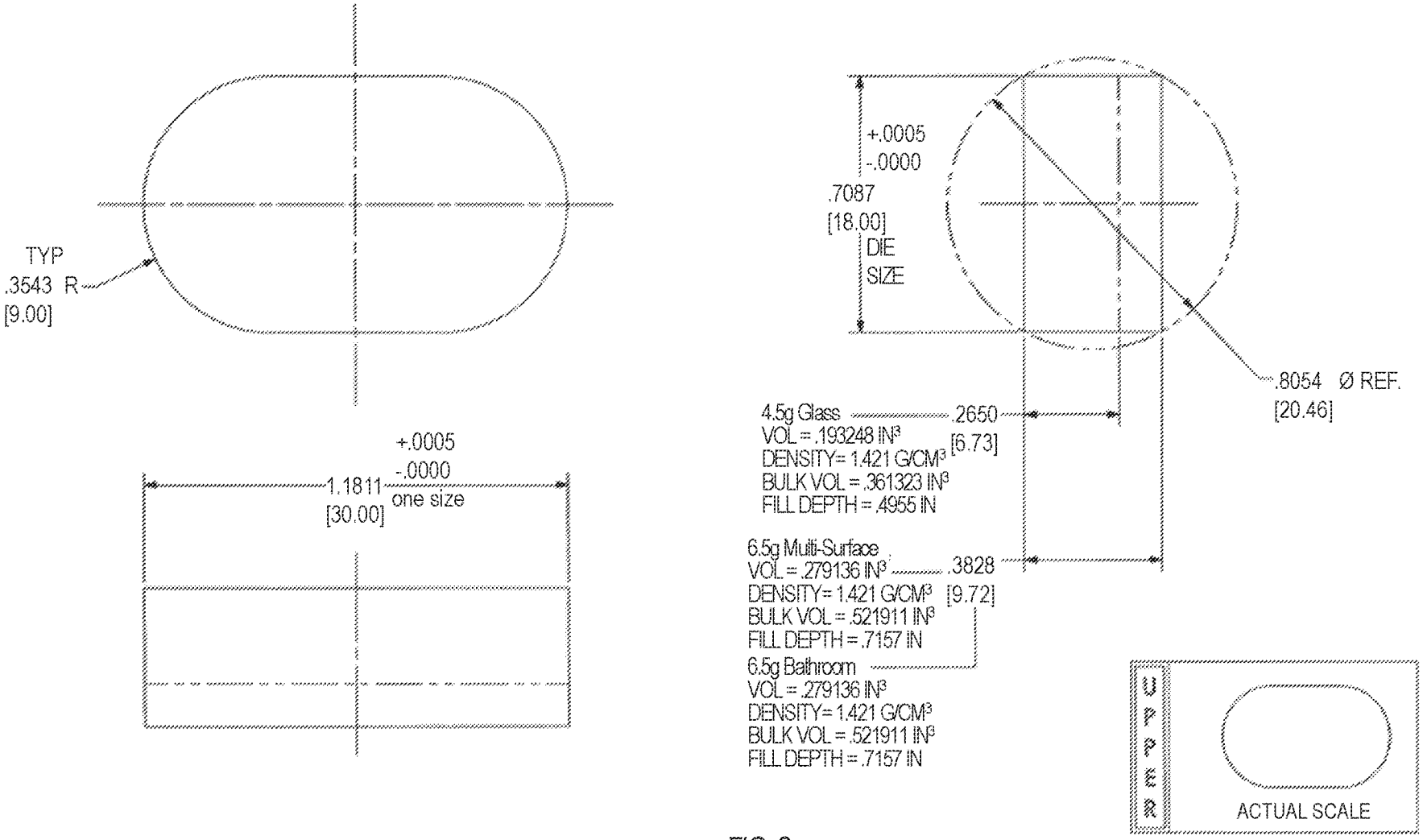
FIG. 2 illustrates an exemplary oblong shaped tablet.
Figure 3:
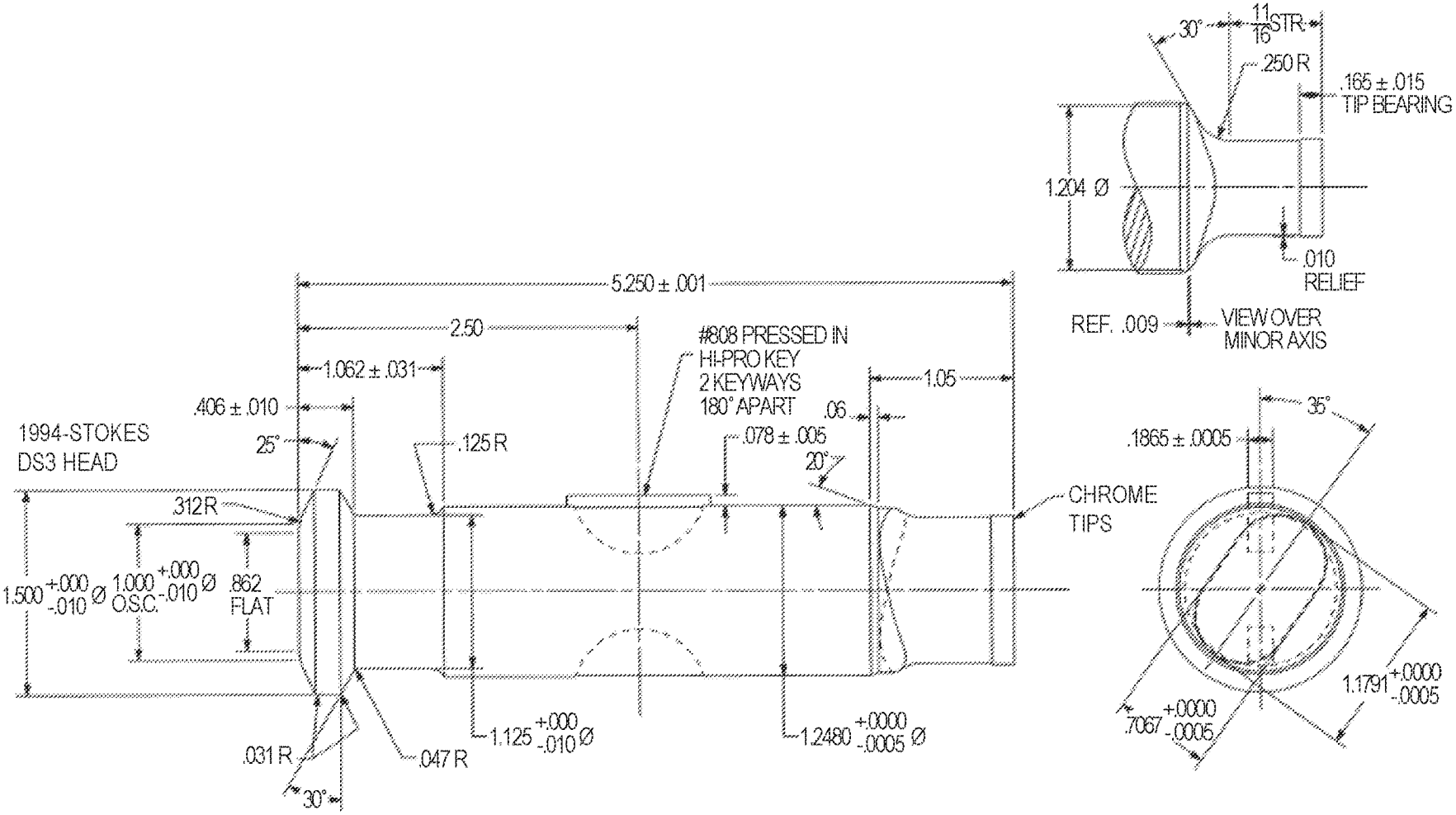
FIG. 3 illustrates an exemplary upper punch for forming an oblong shaped tablet.
Figure 4:
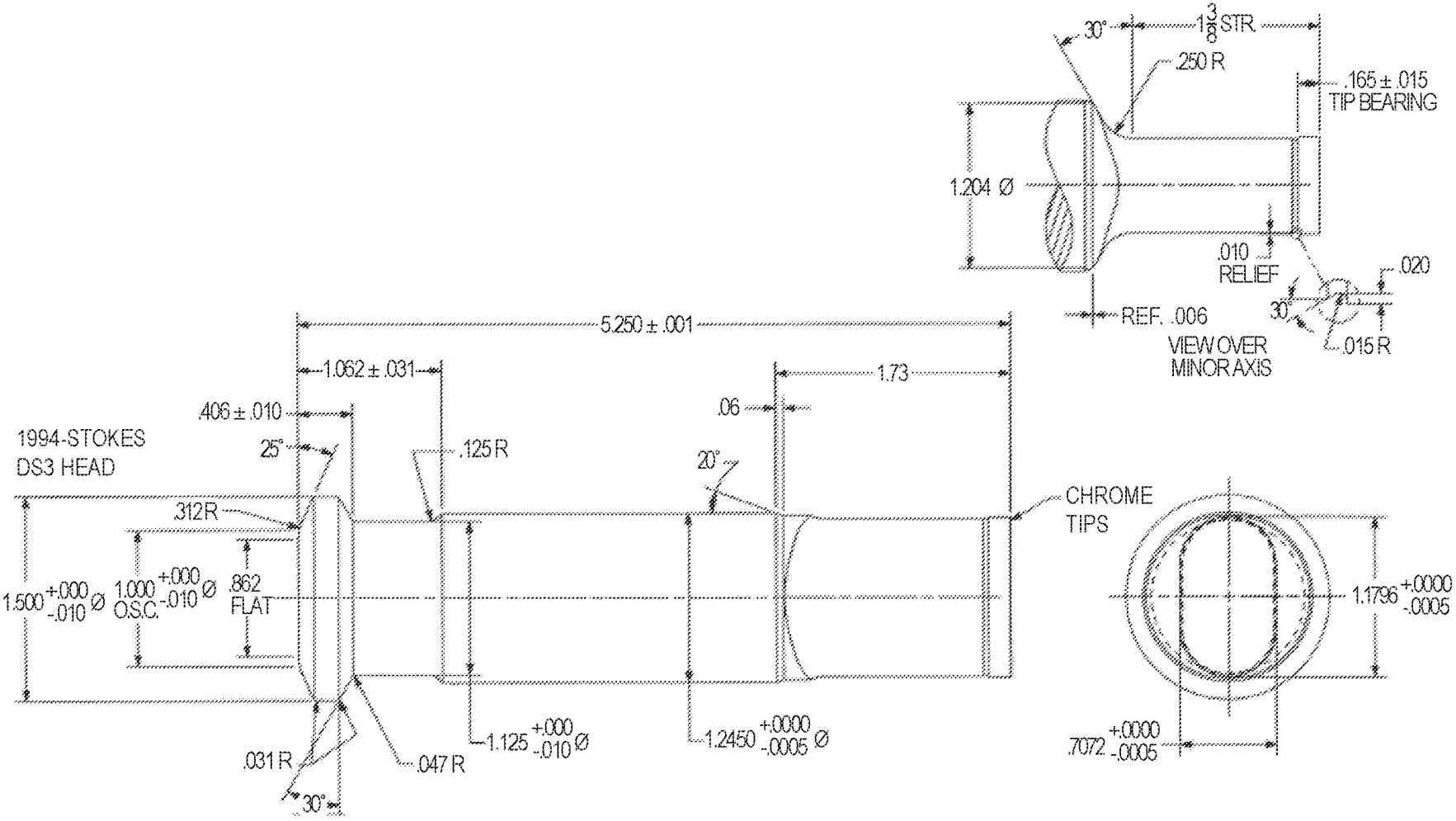
FIG. 4 illustrates an exemplary lower punch for forming an oblong shaped tablet.
Figure 5:
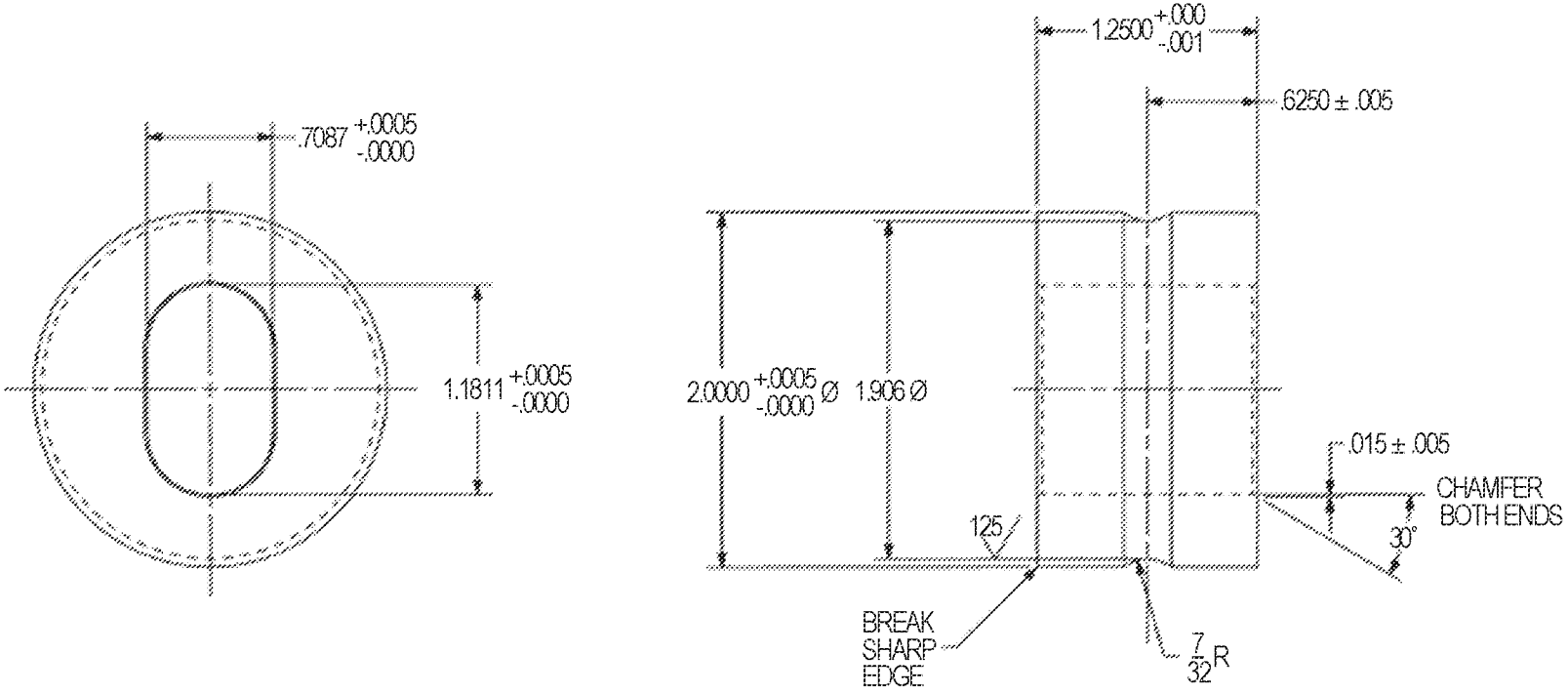
FIG. 5 illustrates an exemplary die for forming an oblong shaped tablet.
Figure 6:
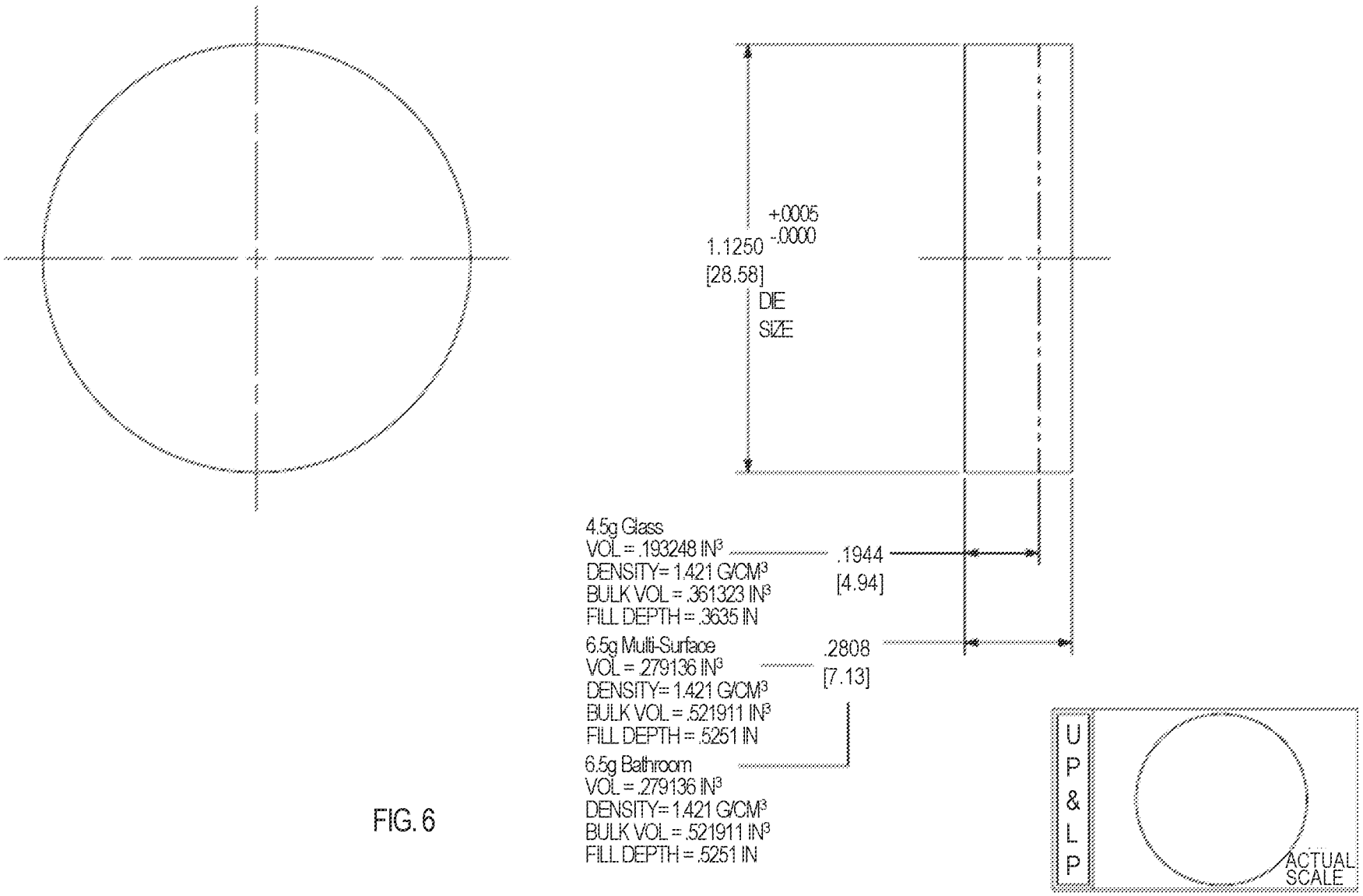
FIG. 6 illustrates an exemplary circular shaped tablet.
Figure 7:
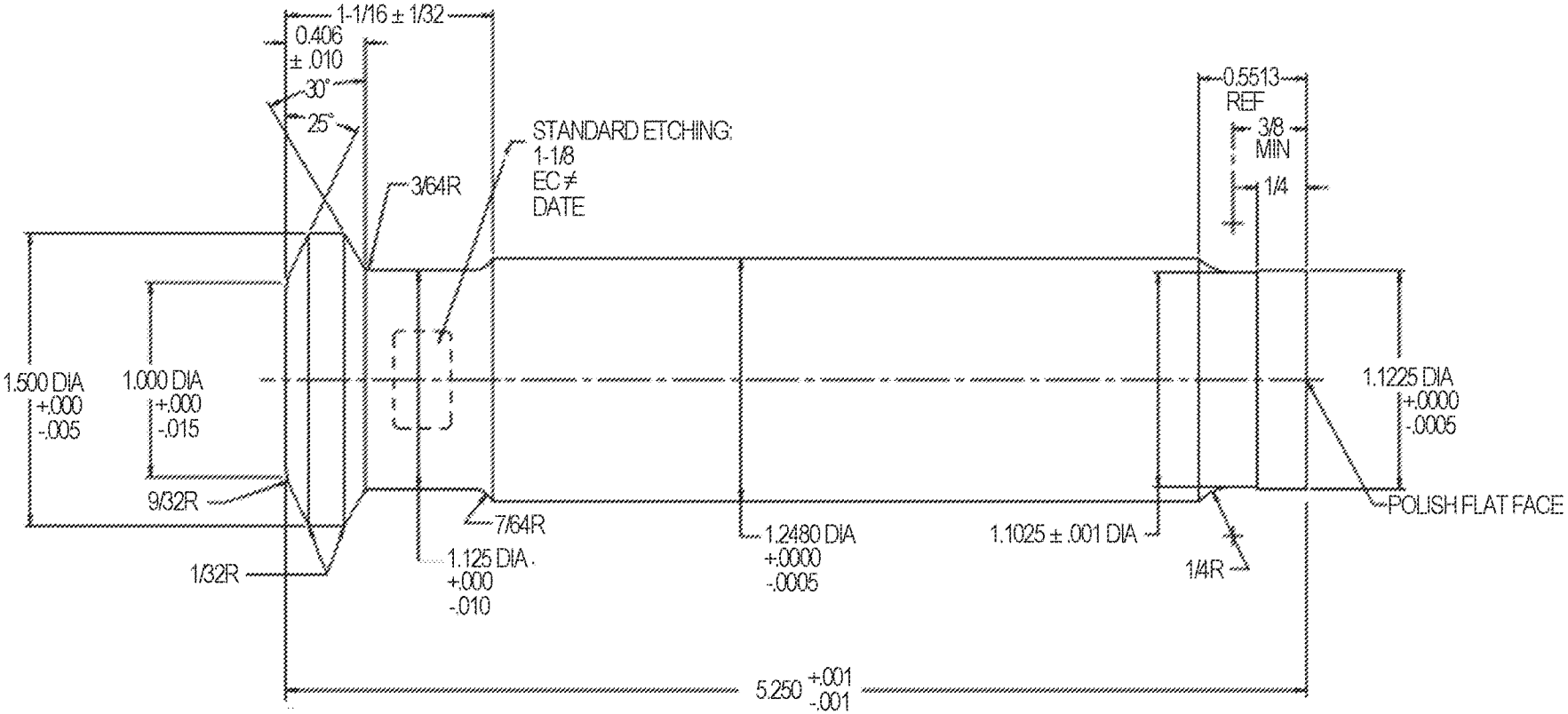
FIG. 7 illustrates an exemplary upper punch for forming a circular shaped tablet.
Figure 8:
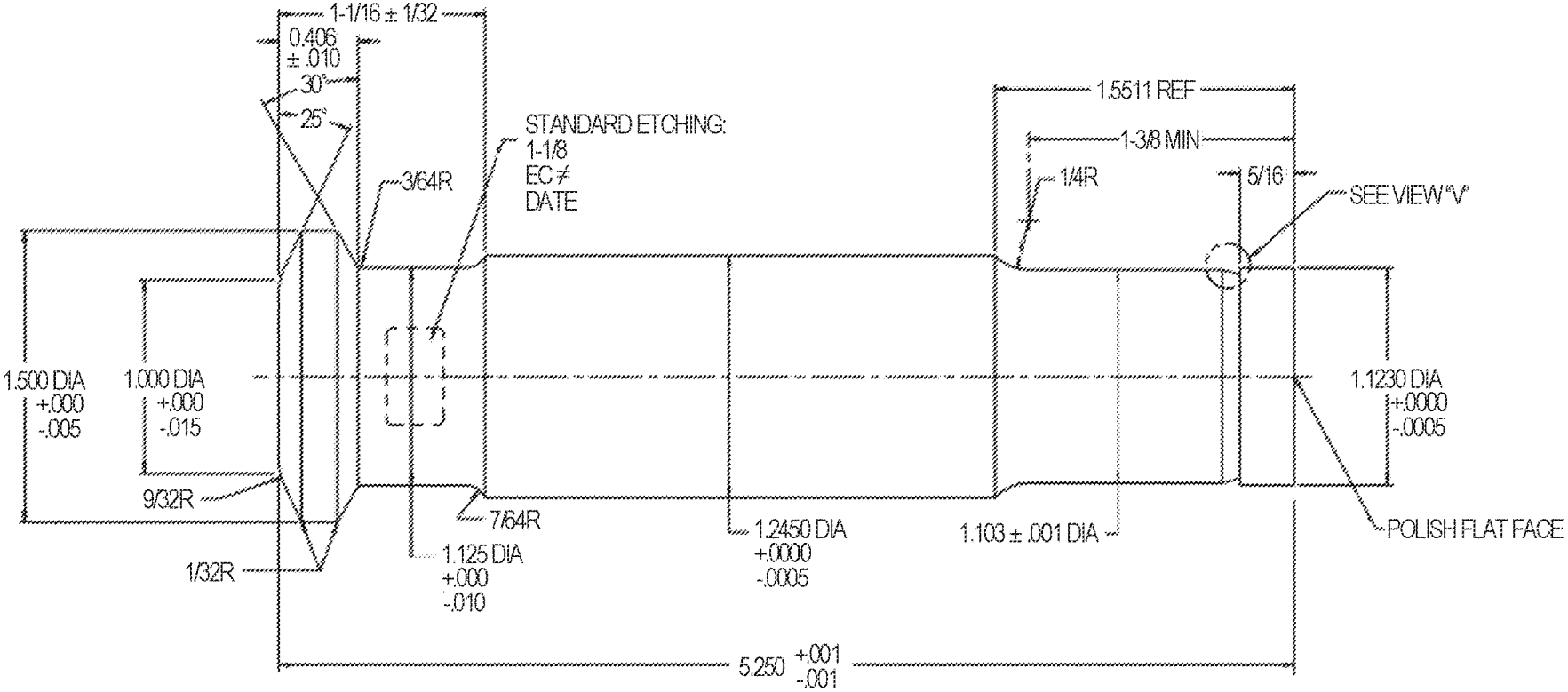
FIG. 8 illustrates an exemplary lower punch for forming a circular shaped tablet.
Figure 9:
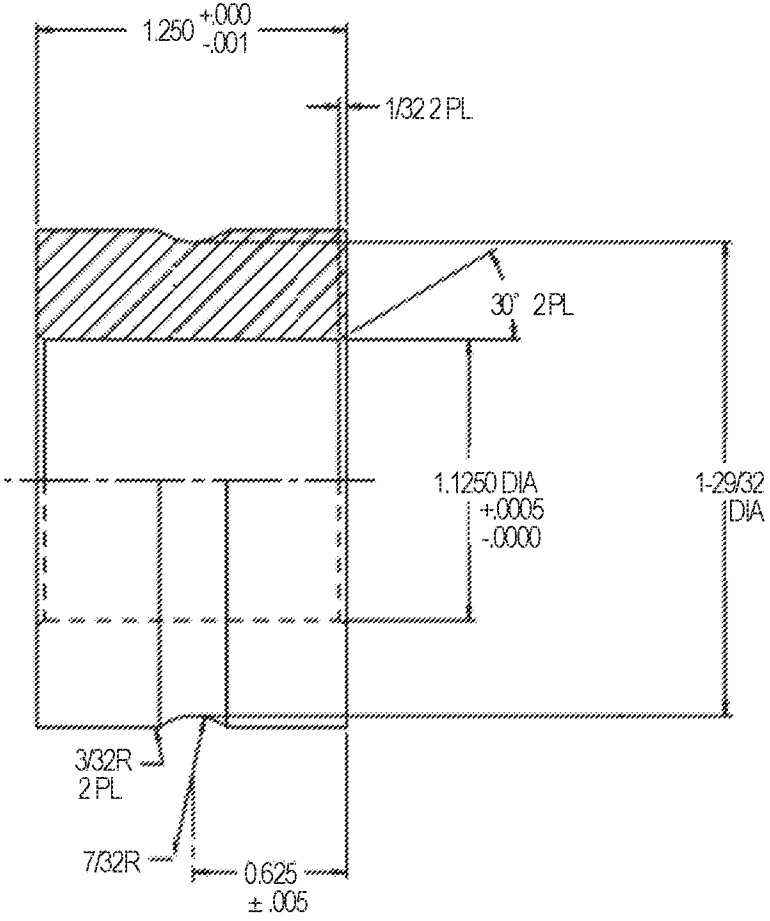
FIG. 9 illustrates an exemplary die for forming a circular shaped tablet.
Figure 9:
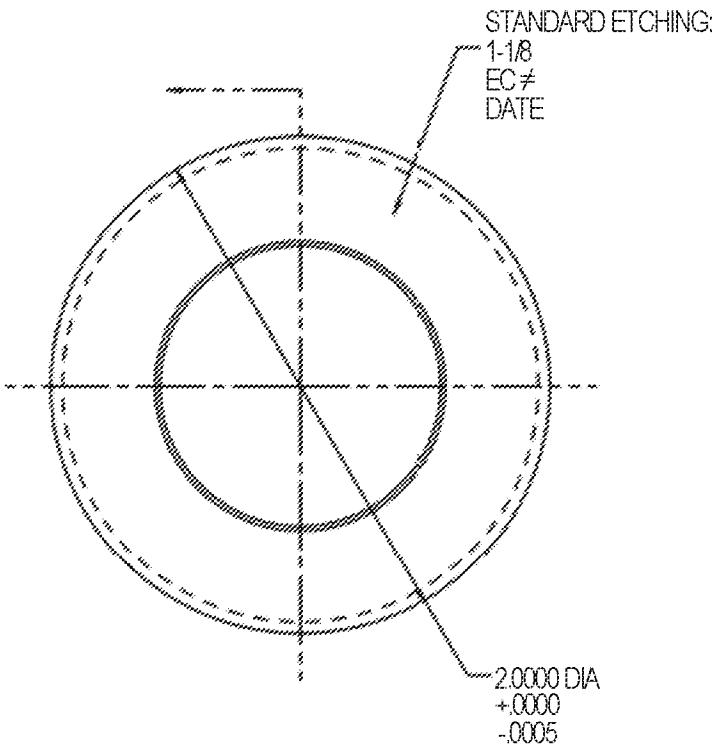

Example tablets, and punches and dies that may be used to produce the tablets are shown in FIGS. 2-9. The values and dimensions shown in FIGS. 2-9 are exemplary and may be modified as necessary for any application of this disclosure. FIG. 2 shows an exemplary oblong tablet. FIG. 3 shows an exemplary upper punch for forming an oblong shaped tablet. FIG. 4 shows an exemplary lower punch for forming an oblong shaped tablet. FIG. 5 shows an exemplary die for forming an oblong shaped tablet. FIG. 6 shows an exemplary circular tablet. FIG. 7 shows an exemplary upper punch for forming a circular shaped tablet. FIG. 8 shows an exemplary lower punch for forming a circular shaped tablet. FIG. 9 shows an exemplary die for forming a circular shaped tablet.

Exemplary Embodiments of Anhydrous Tablets

The exemplary embodiments listed below may be made in tablet form with the aspects of this disclosure.

One set of non-limiting exemplary embodiments is disclosed below:

1. A stable anhydrous cleanser concentrate formulation in a solid form, comprising an acidic cleaner, a basic cleaner, and a surfactant.
2. The stable anhydrous cleanser concentrate formulation of embodiment 1, which is substantially fatty acid free and/or substantially animal fat free.
3. The stable anhydrous cleanser concentrate formulation of embodiment 1 or 2, wherein at least one of the acidic cleaner and the basic cleaner is present in an amount greater than that of the surfactant.
4. The stable anhydrous cleanser concentrate formulation of embodiment 1 or 2, wherein the acidic cleaner and the basic cleaner together are present in an amount greater than that of the surfactant.
5. The stable anhydrous cleanser concentrate formulation of any of embodiments 1-4, wherein the acidic cleaner is present in an amount from about 1% to about 85%, about 5% to about 85%, about 10% to about 75%, about 10% to about 50%, about 15% to about 70%, about 20% to about 65%, about 25% to about 60%, about 30% to about 55%, about 35% to about 50%, or about 40% to about 45% by weight, based on the weight of the formulation.
6. The stable anhydrous cleanser concentrate formulation of embodiment 5, wherein the acidic cleaner is present in an amount from about 10% to about 50% by weight, based on the weight of the formulation.
7. The stable anhydrous cleanser concentrate formulation of any of embodiments 1-6, wherein the acidic cleaner is selected from citric acid and malic acid.

8. The stable anhydrous cleanser concentrate formulation of any of embodiments 1-7, wherein the basic cleaner is present in an amount from about 5% to about 60%, from about 5% to about 30%, from about 10% to about 30%, from about 10% to about 25%, from about 5% to about 10%, from about 40% to about 60%, or from about 35% to about 45%, by weight, based on the weight of the formulation.
9. The stable anhydrous cleanser concentrate formulation of embodiment 8, wherein the basic cleaner is present in an amount from about 5% to about 60%.
10. The stable anhydrous cleanser concentrate formulation of any of embodiments 1-9, wherein the basic cleaner is selected from sodium carbonate, sodium bicarbonate and any other alkali carbonates.
11. The stable anhydrous cleanser concentrate formulation of any of embodiments 1-10, wherein the surfactant is present from about 0.01% to about 40%, from about 1% to about 20%, from about 2% to about 15%, from about 8% to about 12%, from about 1% to about 15%, from about 3% to about 7%, from about 6% to about 20%, from about 16% to about 20%, or from about 10% to 14% by weight, based on the weight of the formulation.
12. The stable anhydrous cleanser concentrate formulation of embodiment 11, wherein the surfactant is present from about 1% to about 20% by weight, based on the weight of the formulation.
13. The stable anhydrous cleanser concentrate formulation of any of embodiments 1-12, wherein the surfactant comprises an anionic and/or nonionic surfactant.
14. The stable anhydrous cleanser concentrate formulation of embodiment 13, wherein the anionic surfactant is selected from sodium coco sulfate and sodium lauryl sulfate.
15. The stable anhydrous cleanser concentrate formulation of embodiment 13 or 14, wherein the nonionic surfactant is selected from ethoxylated alcohol and alkyl polyglucosides.
16. The stable anhydrous cleanser concentrate formulation of any of embodiments 1-15, further comprising a binding agent.
17. The stable anhydrous cleanser concentrate formulation of any of embodiments 1-16, wherein the binding agent is present in an amount ranging from about 0 to about 50%, from about 1% to about 20%, less than about 5%, from about 0 to about 5%, from about 3 to about 7%, from about 4% to about 8%, by weight, based on the weight of the formulation.
18. The stable anhydrous cleanser concentrate formulation of embodiment 16 or 17, wherein the binding agent is selected from polyethylene glycol, sorbitol, and dextrose.
19. The stable anhydrous cleanser concentrate formulation of any of embodiments 1-18, further comprising a preservative and/or preservative booster.
20. The stable anhydrous concentrate formulation of embodiment 19, wherein the preservative is present in an amount ranging about 5% to about 40%, from 5% to about 30%, from about 10% to about 30%, from about 10% to about 25%, or from about 10% to about 20%, by weight, based on the weight of the formulation.
21. The stable anhydrous concentrate formulation of embodiment 19 or 20, wherein the preservative is selected from sodium benzoate, gluconolactone, and biocidal preservatives.
22. The stable anhydrous concentrate formulation of any of embodiments 19-21, wherein the preservative booster is present in an amount ranging from about 0.1% to about 15% by weight, based on the weight of the formulation.
23. The stable anhydrous concentrate formulation of any of embodiments 19-22, wherein the preservative booster is selected from sorbate.
24. The stable anhydrous concentrate formulation of any of embodiments 1-23, comprising citric acid, sodium carbonate, sodium coco sulfate or sodium lauryl sulfate, sodium benzoate, and optionally one ingredient selected from polyethylene glycol, sodium bicarbonate and a sorbate.
25. The stable anhydrous concentrate formulation of any of embodiments 1-24, further comprising an ingredient selected from process aid (flow aid), fragrance, chelating agent, lubricating agent, and a coloring agent.
26. The stable anhydrous concentrate formulation of any of embodiments 1-25, which is in the form of a tablet.
27. The stable anhydrous concentrate formulation of embodiment 26, which is in the form of a tablet wherein the tablet is not tacky.
28. The stable anhydrous concentrate formulation of any of embodiments 1-25, which is in the form of powder.
29. A method of preparing a tablet, comprising blending homogeneously the ingredients of any of embodiments 1-25 to form a mixture and compressing the mixture to form the tablet.
30. A method of using the tablet of embodiment 27 comprising (1) filling a spray bottle or vessel with water, (2) adding the tablet to the water-filled spray bottle or vessel, and (3) dissolving the tablet in appropriate amount of water.
31. The method of embodiment 30, further comprising applying the solution to a surface to be cleaned.
32. A method of using the powder of embodiment 28 comprising diluting the powder in water at a powder to water ratio of greater than or equal to 1:1 (w/w) to form a paste, placing the paste on a surface to be cleaned either directly or through a rag or sponge, leaving overnight soak, and rinsing the surface water.
33. The method of embodiment 31 or 32, wherein the surface to be cleaned is the surface of bathroom, multi-surface, or glass.

Another set of non-limiting exemplary embodiments is disclosed below:

1. A stable anhydrous concentrate formulation in a solid form comprising effervescent ingredients in an amount ranging from about 30% to about 80 or from about 30% to about 55% by weight, preservatives in an amount ranging from about 10% to about 40% or from about 20% to about 40% by weight, and at least one ingredient selected from surfactant, binder, and lubricant in an amount ranging from about 2% to about 25% or from about 10% to about 25% by weight, based on the weight of the formulation.
2. The stable anhydrous concentrate formulation of embodiment 1, wherein the effervescent ingredients comprise an acidic cleaner and a basic cleaner.
3. The stable anhydrous concentrate formulation of embodiment 2, wherein the acidic cleaner is selected from citric acid and malic acid.
4. The stable anhydrous concentrate formulation of embodiment 2 or 3, wherein the basic cleaner is selected from sodium carbonate, sodium bicarbonate and other alkali carbonates.

5. The stable anhydrous concentrate formulation of any of embodiments 1-4, wherein the preservative is selected from odium benzoate, gluconolactone, and biocidal preservatives.
6. The stable anhydrous concentrate formulation of any of embodiments 1-5 wherein the surfactant comprises an anionic and/or nonionic surfactant.
7. The stable anhydrous cleanser concentrate formulation of embodiment 6, wherein the anionic surfactant is selected from sodium coco sulfate and sodium lauryl sulfate.
8. The stable anhydrous cleanser concentrate formulation of embodiment 6 or 7, wherein the nonionic surfactant is selected from ethoxylated alcohol and alkyl polyglucosides.
9. The stable anhydrous cleanser concentrate formulation of any of embodiments 1-8, wherein the binding agent is selected from polyethylene glycol, sorbitol, and dextrose.
10. The stable anhydrous cleanser concentrate formulation of any of embodiments 1-9, wherein the lubricating agent is selected from magnesium stearate, leucine, sodium lauryl sulfate, and sodium benzoate.
11. The stable anhydrous cleanser concentrate formulation of any of embodiments 1-10, further comprising an ingredient selected from process aid (flow aid), fragrance, chelating agent, and a coloring agent.
12. The stable anhydrous concentrate formulation of any of embodiments 1-11, which is in the form of a tablet.
13. The stable anhydrous concentrate formulation of embodiment 12, which is in the form of a tablet wherein the tablet is not tacky.
14. The stable anhydrous concentrate formulation of any of embodiments 1-13, which is in the form of powder.
15. A method of preparing a tablet, comprising blending homogeneously the ingredients of any of embodiments 1-13 to form a mixture and compressing the mixture to form the tablet.
16. A method of using the tablet of embodiment 13 comprising (1) filling a spray bottle or vessel with water, (2) adding the tablet to the water-filled spray bottle or vessel, and (3) dissolving the tablet in appropriate amount of water.
17. The method of embodiment 30, further comprising applying the solution to a surface to be cleaned.
18. A method of using the powder of embodiment 14 comprising diluting the powder in water at a powder to water ratio of greater than or equal to 1:1 (w/w) to form a paste, placing the paste on a surface to be cleaned either directly or through a rag or sponge, leaving overnight soak, and rinsing the surface water.
19. The method of embodiment 17 or 18, wherein the surface to be cleaned is the surface of bathroom, multi-surface, or glass.

Yet another set of non-limiting exemplary embodiments is disclosed below:

1. A stable glass cleanser concentrate tablet or powder, comprising an acidic cleaner, a pH control agent, a solvent, an oily soil remover, and an optional chelating agent.
2. The tablet or powder of embodiment 1, further comprising at least one natural and/or synthetic fragrance.
3. The tablet or powder of embodiment 1 or 2, further comprising a dye or coloring agent.
4. A glass cleanser concentrate tablet or powder, comprising an acidic cleaner, a pH control agent, a solvent, a preservative, and an optional chelating agent.
5. The glass cleanser concentrate tablet or powder of embodiment 4, wherein said tablet or powder produces a solution having a pH of about 5.0 to about 6.0 when dissolved in water.
6. The glass cleanser concentrate tablet or powder of any one of the previous embodiments, wherein said tablet comprises citric acid, sodium carbonate, sodium lauryl sulfate, methylglycinediacetic acid, polyethylene glycol, a preservative, and 2,2-dimethyl-1,3-dioxylane-4-methanol.
7. The glass cleanser concentrate tablet or powder of any one of the previous embodiments, further comprising a coloring agent.
8. The tablet or powder of any one of the previous embodiments, wherein the amount of acidic cleaner ranges from about 1.0% to about 85% by weight, based on the weight of the tablet or powder.
9. A glass cleanser concentrate tablet or powder for use in cleaning, comprising: an acidic cleaner in an amount ranging from about 1% to about 85% by weight a pH control agent in an amount sufficient to adjust the pH to about 4.0 to about 6.0 when dissolved in water, a solvent, an oily soil remover, and an optional chelating agent.
10. The tablet or powder of any one of the previous embodiments, comprising no silica.
11. The glass cleanser concentrate tablet or powder of any one of embodiments 1-10, wherein said tablet weighs about five grams.
12. A method of making a concentrated cleanser tablet or powder for use in cleaning.
13. A method of using the tablet or powder of any one of embodiments 1-11 comprising (I) filling a spray bottle or vessel with water, (2) adding a cleaning tablet or powder to the water-filled spray bottle or vessel, and (3) dissolving the tablet in water.

14. A method of using the powder of any one of embodiments 1-11 comprising diluting the powder in water at a powder to water ratio of greater than or equal to 1:1 (w/w) to form a paste, placing the paste on surface to be cleaned either directly or through a rag or sponge, leaving overnight soak, and rinsing the surface water.

Yet Another set of non-limiting exemplary embodiments is disclosed below:

1. A bathroom cleanser concentrate tablet or powder, comprising an acidic cleaner, a pH control agent, a solvent, an oily soil remover, and an optional chelating agent.
2. The bathroom cleanser tablet or powder of embodiment 1, wherein said tablet produces a low pH solution in the range of about 2.0 to about 5.5 when dissolved in water.
3. The bathroom cleanser tablet or powder of embodiment 1, wherein said tablet produces a high pH solution in the range of about 7.5 to about 12.5 when dissolved in water.
4. The bathroom cleanser tablet or powder of any one of the previous embodiments, wherein said tablet or powder comprises citric acid, sodium carbonate, sodium bicarbonate, sodium metasilicate, one or more ethoxylated alcohols, methylglycinediacetic acid, polyethylene glycol, silicon dioxide, and magnesium stearate.
5. The bathroom cleanser tablet or powder of any one of the previous embodiments, further comprising at least one of a fragrance and a coloring agent.
6. The tablet or powder of any one of the previous embodiments, wherein the binding agent ranges from about 1% to about 20% by weight.

7. The tablet or powder of any one of the previous embodiments, wherein the amount of acidic cleaner ranges from about 1.0% to about 85% by weight, based on the weight of the tablet or powder.
8. A cleanser concentrate tablet or powder for use in cleaning, comprising: an acidic cleaner in an amount ranging from about I % to about 85% by weight, a pH control agent in an amount sufficient to adjust the pH to about 2.5 to about 12.5 when dissolved in water, a solvent, an oily soil remover, and an optional chelating agent.
9. The tablet or powder of embodiment 8, further comprising a buffer in an amount sufficient to adjust the pH when dissolved in water from about 2.0 to about 12.5.
10. The tablet or powder of any of the preceding embodiments, comprising no silica.
11. A method of making a concentrated bathroom cleanser tablet or powder for use in cleaning.
12. A method of using the bathroom cleanser tablet or powder of any one of embodiments 1-10 comprising: (1) filling a spray bottle or vessel with water, (2) adding one or more cleaning tablets to the water filled spray bottle or vessel, and (3) dissolving the tablet in water.
13. A method of using the powder of any one of embodiments 1-10 comprising diluting the powder in water at a powder to water ratio of greater than or equal to 1:1 (w/w) to form a paste, placing the paste on surface to be cleaned either directly or through a rag or sponge, leaving overnight soak, and rinsing the surface water.

Yet another set of non-limiting embodiments is disclosed below:

1. A stable multi-surface cleanser concentrate tablet or powder, comprising an acidic cleaner, a pH control agent, a solvent, an oily soil remover, and an optional chelating agent.
2. The tablet or powder of embodiment 1, further comprising at least one natural and/or synthetic fragrance.
3. The tablet or powder of embodiment 1 or 2, further comprising a dye or coloring agent.
4. A multi-surface cleanser concentrate tablet or powder, comprising an acidic cleaner, a pH control agent, a binding agent, a solvent, a preservative, an oily soil remover, and an optional chelating agent.
5. The multi-surface cleanser tablet or powder of embodiment 4, wherein said tablet produces a low pH solution in the range of about 4.0 to about 6.5 when dissolved in water.
6. The multi-surface cleanser tablet or powder of embodiment 4, wherein said tablet produces a high pH solution in the range of about 7.5 to about 11.0 when dissolved in water.
7. The multi-surface cleanser tablet of any one of the previous embodiments, wherein said tablet or powder comprises citric acid, sodium carbonate, one or more ethoxylated alcohols, methylglycinediacetic acid, polyethylene glycol, a preservative, silicon dioxide, and magnesium stearate.
8. The multi-surface cleanser tablet or powder of any one of embodiments 9-13, further comprising at least one of a fragrance and a coloring agent.
9. The tablet or powder of any one of the previous embodiments, wherein the binding agent ranges from about I % to about 20% by weight.
10. The tablet or powder of any one of the previous embodiments, wherein the amount of acidic cleaner ranges from about 1.0% to about 85% by weight, based on the weight of the tablet or powder.
11. A cleanser concentrate tablet or powder for use in cleaning, comprising: an acidic cleaner in an amount ranging from about 1% to about 85% by weight, a pH control agent in an amount sufficient to adjust the pH to about 2.5 to about 12.5 when dissolved in water, a solvent, an oily soil remover, and an optional chelating agent.
12. The tablet or powder of embodiment 11, further comprising a buffer in an amount sufficient to adjust the pH when dissolved in water from about 2.0 to about 12.5.
13. The tablet or powder of any one of the previous embodiments, comprising no silica.
14. A method of making a concentrated multi-surface cleanser tablet or powder for use in cleaning.
15. A method of using the tablet or powder of any one of the previous embodiments comprising (1) filling a spray bottle or vessel with water, (2) adding a cleaning tablet or powder to the water-filled spray bottle or vessel, and (3) dissolving the tablet in water.
16. A method of using the powder of any one of embodiments 1-13 comprising diluting the powder in water at a powder to water ratio of greater than or equal to 1:1 (w/w) to form a paste, placing the paste on surface to be cleaned either directly or through a rag or sponge, leaving overnight soak, and rinsing the surface water.

Yet another set of non-limiting embodiments is disclosed below:

1. A stable anhydrous hand soap concentrate formulation in a solid form, comprising a surfactant and a pH control agent, wherein the stable anhydrous hand soap concentrate formulation is substantially fatty acid free and/or substantially animal fat free.
2. The stable anhydrous hand soap concentrate formulation of embodiment 1, wherein the pH control agent is present in an amount that is greater than the amount of the surfactant.
3. The stable anhydrous hand soap concentrate formulation of embodiment 1 or 2, wherein the pH control agent is present in an amount ranging from 1% to about 85%, from about 15% to about 20%, from about 20% to about 60%, from about 20% to about 45%, from about 25% to about 35%, from 5% to about 40%, from about 5% to about 30%, from about 10% to about 30%, from about 10% to about 25%, from about 5% to about 10%, from about 40% to about 60%, from about 35% to about 45%, from about 30% to about 55%, or from about 35% to about 55%, by weight, based on the weight of the formulation.
4. The stable anhydrous hand soap concentrate formulation of any of embodiments 1-3, wherein the surfactant is present in an amount ranging from about 0.01% to about 40%, from about 1% to about 20%, from about 10% to about 20%, from about 10% to about 25%, from about 10% to about 40%, from about 5% to about 15%, from about 5% to about 25%, or from about 15% to about 25%, by weight, based on the weight of the formulation.
5. The stable anhydrous hand soap concentrate formulation of any of embodiments 1-4, wherein the surfactant comprises an anionic and/or nonionic surfactant.
6. The stable anhydrous hand soap concentrate formulation of embodiment 5, wherein the anionic surfactant is selected from sodium coco sulfate and sodium lauryl sulfate.

7. The stable anhydrous hand soap concentrate formulation of embodiment 5 or 6, wherein the nonionic surfactant is selected from ethoxylated alcohol and alkyl polyglucosides.
8. The stable anhydrous hand soap concentrate formulation of any of embodiments 1-7, wherein the pH control agent comprises an acidic cleaner.
9. The stable anhydrous hand soap concentrate formulation of any of c embodiments 1-7, wherein the pH control agent comprises a basic cleaner.
10. The stable anhydrous hand soap concentrate formulation of any of embodiments 1-7, wherein the pH control agent comprises an acidic cleaner and a basic cleaner.
11. The stable anhydrous hand soap concentrate formulation of embodiment 8 or 10, wherein the acidic cleaner is selected from citric acid and malic acid.
12. The stable anhydrous hand soap concentrate formulation of any of embodiments 9-11, wherein the basic cleaner is selected from sodium carbonate, sodium bicarbonate and any other alkali carbonates.
13. The stable anhydrous hand soap concentrate formulation of any of embodiments 1-12, further comprising a binding agent.
14. The stable anhydrous hand soap concentrate formulation of embodiment 13, wherein the binding agent is present in an amount ranging from 0% to about 30%, less than 5%, from about 0% to about 10%, from about 0% to about 20%, from about 3% to about 8%, from about 5% to about 15% by weight, based on the weight of the formulation.
15. The stable anhydrous hand soap concentrate formulation of embodiment 13 or 14, wherein the binding agent is selected from polyethylene glycol, sorbitol, and dextrose.
16. The stable anhydrous hand soap concentrate formulation of any of embodiments 1-15, further comprising a thickening agent.
17. The stable anhydrous hand soap concentrate formulation of embodiment 16, wherein the thickening agent is present in an amount ranging from about 1% to about 15%, from about 1% to about 10%, or from 5% to about 10%, by weight, based on the weight of the formulation.
18. The stable anhydrous hand soap concentrate formulation of embodiment 16 or 17, wherein the thickening agent is selected from xanthium gum, NaCl, KCl, potassium alginate, guar gum, and HPMC.
19. The stable anhydrous hand soap concentrate formulation of any of embodiments 1-18, further comprising a preservative and/or preservative booster.
20. The stable anhydrous hand soap concentrate formulation of embodiment 19, wherein the preservative is present in an amount ranging from 5% to about 40%, from 5% to about 30%, from about 10% to about 30%, from about 10% to about 25%, or from about 10% to about 20%, by weight, based on the weight of the formulation.
21. The stable anhydrous hand soap concentrate formulation of embodiment 19 or 20, wherein the preservative booster is present in an amount ranging from about 0.1% to about 10%, from about 0.5% to about 10%, from about 1% to about 10%, or from about 1% to about 5%, by weight, based on the weight of the formulation.
22. The stable anhydrous hand soap concentrate formulation of any of embodiments 19-21, wherein the preservative is selected from sodium benzoate, gluconolactone, and biocidal preservatives.
23. The stable anhydrous hand soap concentrate formulation of any of embodiments 19-22, wherein the preservative booster is selected from sorbate.
24. The stable anhydrous hand soap concentrate formulation of any of embodiments 1-23, further comprising an ingredient selected from process aid, fragrance, chelating agent, lubricating agent, and a coloring agent.
25. The stable anhydrous hand soap concentrate formulation of any of embodiments 1-24, wherein said formulation produces a low pH solution in the range of about 4.0 to about 6.0 when dissolved in appropriate amount of water
26. The stable anhydrous hand soap concentrate formulation of any of embodiments 1-25, comprising citric acid, sodium carbonate, sodium lauryl sulfate, ethoxylated alcohol, polyethylene glycol, and optionally a coloring agent.
27. The stable anhydrous hand soap concentrate formulation of any of embodiments 1-25, comprising citric acid, sodium carbonate, sodium coco sulfate, sodium benzoate, sodium alginate, polyethylene glycol, sorbitol, medium-chain triglycerides oil, and a fragrance.
28. The stable anhydrous hand soap concentrate formulation of any of embodiments 1-27, which is in the form of a tablet.
29. The stable anhydrous hand soap concentrate formulation of embodiment 28, which is in the form of a tablet wherein the tablet is not tacky.
30. A method of preparing a tablet, comprising blending homogeneously the ingredients of any of embodiments 1-28 to form a mixture and compressing the mixture to form the tablet.
31. A method of using the tablet of embodiment 29 comprising (1) filling a bottle or vessel with water, (2) adding the tablet to the water-filled bottle or vessel, and (3) dissolving the tablet in appropriate amount of water.

Another set of non-limiting exemplary embodiments are disclosed below:

1. A stable anhydrous hand soap concentrate formulation in a solid form, comprising a surfactant and a pH control agent, wherein the stable anhydrous hand soap concentrate formulation is substantially fatty acid free and/or substantially animal fat free.
2. The stable anhydrous hand soap concentrate formulation of embodiment 1, further comprising an ingredient selected from a preservative, a preservative booster, a water softening agent, an emollient, a viscosity adjuster, an acidic cleaner, a basic cleaner, a thickening agent, and a binding agent.
3. The stable anhydrous hand soap concentrate formulation of embodiment 2, wherein the ingredient is selected from preservative and a water softening agent.
4. A stable and anhydrous foaming hand soap concentrate tablet, comprising an acidic cleaner, a binding agent, and a surfactant.
5. The tablet of embodiment 4, further comprising a pH control agent and a chelating agent.
6. The tablet of embodiment 5, further comprising at least one natural and/or synthetic fragrance.
7. The tablet of embodiment 5 or 6, further comprising a dye or coloring agent.
8. The tablet of any of embodiments 4-6, wherein said tablet produces a low pH solution in the range of about 4.0 to about 6.0 when dissolved in appropriate amount of water.

9. The tablet of embodiment 4, comprising an acidic cleaner, a pH control agent, a binding agent, a surfactant, a preservative and a lubricating agent.
10. The tablet of embodiment 4, comprising an acidic cleaner, a pH control agent, an anionic surfactant, a binding agent, a preservative and a lubricating agent.
11. The tablet of embodiment 4, comprising an acidic cleaner, a pH control agent, a non-ionic surfactant, a binding agent, and a lubricating agent.
12. The tablet of embodiment 11, wherein said tablet produces a solution having a pH of about 4.0 to about 6.0 when dissolved in appropriate amount of water.
13. The tablet of embodiments 4, wherein said tablet comprises citric acid, malic acid, sodium bicarbonate, sodium coco sulfate, dextrose, polyethylene glycol, a preservative, and medium chain triglyceride oil liquid.
14. The tablet of embodiments 11 or 12, comprising citric acid, sodium bicarbonate, ethoxylated alcohol, polyethylene glycol, and magnesium stearate.
15. The foaming hand soap concentrate tablet of any one of embodiments 10-14, further comprising a fragrance.
16. The tablet of any of embodiments 4-12, further comprising a basic cleaner to form a effervescent tablet.
17. The tablet of embodiment 16, further comprising a thickening agent.
18. The tablet of embodiment 17, wherein the thickening agent is selected from sodium alginate, potassium alginate, and HMPC.
19 The tablet of embodiment 17 or 18, further comprising a preservative and optionally a preservative booster.
20. The tablet of embodiment 19, further comprising a process aid/emollient.
21. The tablet of embodiment 20, comprising citric acid, sodium carbonate, sodium coco sulfate, sodium benzoate, sodium alginate, polyethylene glycol, sorbitol, a preservative booster, a fragrance, and medium chain triglycerides.
22. The tablet of any one of embodiments 4-21, wherein the binding agent ranges from about 1% to about 20% by weight.
23. The tablet of any one of embodiments 4-21, wherein the amount of acidic cleaner ranges from about 1.0% to about 85% by weight, based on the weight of the tablet.
24. A stable and anhydrous foaming hand soap concentrate tablet for use in cleaning hand, comprising:
an acidic cleaner in an amount ranging from about 1% to about 85% by weight, a pH control agent in an amount sufficient to adjust the pH to about 4.5 to about 5.5 when dissolved in appropriate amount of water, a chelating agent, a binding agent, and surfactant.
25. A method of using the tablet of any one of embodiments 4-30 comprising (1) filling a spray bottle with water, (2) adding the tablet to the water-filled spray bottle, and (3) dissolving the tablet in appropriate amount of water.

EXEMPLIFICATION

Materials used in the following examples and their sources are listed below.

Example 1

A glass cleaner tablet was produced, using the following ingredients:

TABLE 1

| Raw Materials | Chemistry | Function in tablet | Function in final dilution | Weight (%) |
|---|---|---|---|---|
| Citric Acid | Citric Acid | Acid for effervescent | Acidic Cleaner | 20-25 |
| Sodium Carbonate | Sodium Carbonate Dense | Base for effervescent | Cleaner/pH control | 20-25 |
| Sodium Lauryl Sulfate | Sodium Lauryl Sulfate | Anionic Surfactant | cleaner | 8-12 |
| Trilon-MSG | methylglycinediacetic acid | Chelating agent | Chelating agent | 3-7 |
| PEG 8000 | Polyethylene Glycol 8000 | Binder | solvent | 3-7 |
| Neo Defend | Gluconolactone & Sodium Benzoate (GSB) | Preservative | preservative | 30-35 |
| Augeo Clean Multi | 2,2-dimethyl-1,3-dioxylane-4-methanol | settle the dust from SLS | solvent | 0.5-2.0 |
| Dye/colorant | FD&C or polymetric dye | visual effect | visual effect | 0.001-0.01 |
| Total | | | | 100.00 |
| pH | | | | pH 5.0-6.0 |
| Liquid Load (%) | | | | 1.00 |

Example 2

Glass Cleaner: Tablet weight (g)—5.0 g

TABLE 2

| Ingredients | % | Weight (grams) |
|---|---|---|
| Effervescent Ingredients | 45-55% | 2.25-2.75 g |
| Preservatives | 30-40% | 1.50-2.00 g |
| Surfactant, Binder, Lubricant, etc | 10-20% | 0.5-1.00 g |

To preserve 20 oz of tap water with the glass cleaning concentrate formulation disclosed herein, 1.50-2.00 grams of preservatives are needed. In order for the tablets to dissolve in reasonable time (-8-10 mins), about 45-55% Effervescent ingredients are needed. After all the other ingredients (Surfactant, Binder, Lubricant, etc) are combined, the lowest weight is landing around 4.5 grams. A 5.0 grams for glass cleaner tablets are prepared to give little extra Effervescent ingredients to help reduce the dissolution time.

Example 3

A glass cleaner tablet was produced, using the following ingredients:

TABLE 3

| Raw Materials | Chemistry | Function in tablet | Function in final dilution | Weight (%) |
|---|---|---|---|---|
| Citric Acid | Citric Acid | Acid for effervescent | Acidic Cleaner | 25-35 |
| Sodium Benzoate | Sodium Benzoate | Preservative | Preservative | 15-25 |
| Sodium Bicarbonate | Sodium Bicarbonate Dense | Base for effervescent | Cleaner/pH control | 0-14 |
| Potassium Sorbate | Potassium Sorbate | preservative booaster | preservative booaster | 5-15 |
| Sodium Carbonate | Sodium Carbonate | Base for effervescent | Cleaner/pH control | 7-25 |
| Sodium Lauryl Sulfate | Sodium Lauryl Sulfate | Anionic Surfactant | cleaner | 1-15 |
| Gluconolactone | Gluconolactone | Preservative booster | Preservative booster | 0-6 |
| PEG 8000 | Polyethylene Glycol 8000 | Binder | solvent | <5 |
| L-leucine | L-leucine | lubricant | | 0-5 |
| Augeo Clean Multi (Isopropylidene Glycerol) | 2,2-dimethyl-1,3-dioxylane-4-methanol | Process aid | | 0-2 |
| Liquitint Winter Blue Basic | Polymeric dye | colorant | solvent | 0-1 |
| pH | | | | pH 4.5-5.5 |

Example 4

A multi-surface low pH cleanser tablet was produced, using the following ingredients:

TABLE 4

| Raw Materials | Chemistry | Function in tablet | Function in final dilution | Weight (%) |
|---|---|---|---|---|
| Citric Acid | Citric Acid | Acid for effervescent | Acidic Cleaner | 28-32 |
| Sodium Carbonate | Sodium Carbonate Dense | Base for effervescent | Cleaner/pH control | 22-25 |
| BASF Lutensol AT 25 | ethoxylated alcohols | Nonionic Surfactant | oily soil remover | 3-7 |
| Trilon-MSG | methylglycinediacetic acid | Chelating agent | Chelating agent | 3-7 |
| PEG 8000 | Polyethylene Glycol 8000 | Binder | solvent | 3-7 |
| Neo Defend | Gluconolactone & Sodium Benzoate (GSB) | Preserative | preservative | 25-30 |
| Sipernat 50/PPG Hi-Sil ABS Silica | Silicon dioxide | Carrier for liquid ingredients/flow aid | inert material | 0.1-1.0 |
| Magnesium Stearate | Magnesium Stearate | Lubricate | inert material | 0.1-1.0 |
| Fragrance | n/a | sensorial effect | sensorial effect | 1-4 |
| Dye/colorant | FD&C or polymetric dye | visual effect | visual effect | 0.001-0.01 |
| Total | | | | 100.00 |
| pH | | | | pH 3.5-4.5 |
| Liquid Load (%) | | | | 2.00 |

Example 5

A high pH multi-surface cleanser tablet was produced, using the following ingredients:

TABLE 5

| Raw Materials | Chemistry | Function in tablet | Function in final dilution | Weight (%) |
|---|---|---|---|---|
| Citric Acid | Citric Acid | Acid for effervescent | pH control | 15-19 |
| Sodium Carbonate | Sodium Carbonate Dense | Base for effervescent | Cleaner/pH control | 37-43 |
| Sodium Bicarbonate | Sodium Bicarbonate Grade 5 | Base for effervescent | Cleaner/pH Control | 8-12 |
| Sodium Metasilicate | Sodium Metasilicate anhydrous | pH control | Anti-corrosion inhibitor | 9-13 |
| BASF Lutensol AT 25 | ethoxylated alcohols | Nonionic Surfactant | oily soil remover | 3-7 |
| Trilon-MSG | methylglycinediacetic acid | Chelating agent | Chelating agent | 3-7 |
| PEG 8000 | Polyethylene Glycol 8000 | Binder | solvent | 3-7 |
| Sipernat 50/PPG Hi-Sil ABS Silica | Silicon dioxide | Carrier for liquid ingredients | inert material | 0.1-1.0 |
| Magnesium Stearate | Magnesium Stearate | Lubricate | inert material | 0.1-1.0 |
| Fragrance | n/a | sensorial effect | sensorial effect | 1-3 |
| Dye/colorant | FD&C or polymetric dye | visual effect | visual effect | 0.001-0.01 |
| Total | | | | 100.00 |
| pH | | | | pH 9.5-10.5 |
| Liquid Load (%) | | | | 2.00 |

Example 6

Multi-Surface Tablet size—6.5 g

TABLE 6

| Ingredients | % | Weight (grams) |
|---|---|---|
| Effervescent Ingredients | 45-55% | 3.00-3.60 g |
| Preservatives | 20-30% | 1.50-2.00 g |
| Surfactant, Binder, Lubricant, etc | 15-25% | 1.00-1.60 g |

Example 7

A low pH multi-surface low pH cleanser tablet was produced, using the following ingredients

TABLE 7

| Raw Materials | Chemistry | Function in tablet | Function in final dilution | Weight (%) |
|---|---|---|---|---|
| Citric Acid | Citric Acid | Acid for effervescent | Acidic Cleaner | 27-38 |
| Sodium Carbonate | Sodium Carbonate | Base for effervescent | Cleaner/pH control | 14-25 |
| Sodium Benzoate | Sodium Benzoate | Preservative | Preservative | 10-30 |
| Gluconolactone | Gluconolactone | Preservative booster | Preservative booster | 0-12 |
| Sodium Coco Sulfate | Sodium Coco Sulfate | Anionic Surfactant | cleaner | 6-20 |
| Potassium Sorbate | Potassium Sorbate | preservative booaster | preservative booaster | 4-15 |
| PEG 8000 | Polyethylene Glycol 8000 | Binder | solvent | 0-5 |
| L-leucine | L-leucine | lubricant | | 0-3 |
| Sipernat 50/PPG Hi-Sil ABS Silica | Silicon dioxide | Flow aid | | 0-3.0 |

TABLE 7-continued

| Raw Materials | Chemistry | Function in tablet | Function in final dilution | Weight (%) |
|---|---|---|---|---|
| Fragrance Lemon APC | Fragrance | scent | | 0-3.0 |
| Bio-Soft N91-8 | Alcohol Ethoxylate C9-C11 8EO | emulsifier | | 0-2 |
| Medium-chain triglycerides Oil | Medium-chain triglycerides Oil | Process aid | | 0-1 |
| Liquitint Bright Yellow | polymeric dye | colorant | | 0-0.1 |
| pH | | | | pH 4.5-5.5 |

Example 8

A low pH bathroom cleanser tablet was produced, using the following ingredients:

TABLE 8

| Raw Materials | Chemistry | Function in tablet | Function in final dilution | Weight (%) |
|---|---|---|---|---|
| Citric Acid | Citric Acid | Acid for effervescent | Acidic Cleaner | 32-40 |
| Sodium Carbonate | Sodium Carbonate Dense | Base for effervescent | Cleaner/pH control | 5-9 |
| Sodium Bicarbonate | Sodium Bicarbonate | Base for effervescent | Cleaner/pH control | 6-10 |
| BASF Lutensol AT 25 | ethoxylated alcohols | Nonionic Surfactant | oily soil remover | 16-20 |
| Trilon-MSG | methylglycinediacetic acid | Chelating agent | Chelating agent | 3-7 |
| PEG 8000 | Polyethylene Glycol 8000 | Binder | solvent | 3-7 |
| Neo Defend | Gluconolactone & Sodium Benzoate (GSB) | Preservative | preservative | 10-16 |
| Sipernat 50/PPG Hi-Sil ABS Silica | Silicon dioxide | Carrier for liquid ingredients | inert material | 3-7 |
| Magnesium Stearate | Magnesium Stearate | Lubricate | inert material | 0.1-1.0 |
| ethoxylated alcohols (liquid) | ethoxylated alcohols C8-C10 6-8 moles of EO | Nonionic Surfactant narrow cut | oily soil remover | 1-3 |
| Fragrance | n/a | sensorial effect | sensorial effect | 1-3 |
| Dye/colorant | FD&C or polymetric dye | visual effect | visual effect | 0.001-0.01 |
| Total | | | | 100.00 |
| pH | | | | pH 3.5-4.5 |
| Liquid Load (%) | | | | 3.00 |

Example 9

A high pH bathroom cleaner tablet was produced, using the following ingredients:

TABLE 9

| Raw Materials | Chemistry | Function in tablet | Function in final dilution | Weight (%) |
|---|---|---|---|---|
| Citric Acid | Citric Acid | Acid for effervescent | pH control | 14-18 |
| Sodium Carbonate | Sodium Carbonate Dense | Base for effervescent | Cleaner/pH control | 35-45 |
| Sodium Bicarbonate | Sodium Bicarbonate Grade 5 | Base for effervescent | Cleaner/pH Control | 6-10 |
| Sodium Metasilicate | Sodium Metasilicate anhydrous | pH control | Anti-corrosion inhibitor | 8-12 |
| BASF Lutensol AT 25 | ethoxylated alcohols | Nonionic Surfactant | oily soil remover | 10-14 |
| Trilon-MSG | methylglycinediacetic acid | Chelating agent | Chelating agent | 3-7 |

TABLE 9-continued

| Raw Materials | Chemistry | Function in tablet | Function in final dilution | Weight (%) |
|---|---|---|---|---|
| PEG 8000 | Polyethylene Glycol 8000 | Binder | solvent | 4-8 |
| Sipernat 50/PPG Hi-Sil ABS Silica | Silicon dioxide | Carrier for liquid ingredients | inert material | 1-10 |
| Magnesium Stearate | Magnesium Stearate | Lubricate | inert material | 0.1-2.0 |
| ethoxylated alcohols (liquid) | ethoxylated alcohols C8-C10 6-8 moles of EO | Nonionic Surfactant narrow cut | oily soil remover | 1-3 |
| Fragrance | n/a | sensorial effect | sensorial effect | 1-3 |
| Dye/colorant | FD&C or polymetric dye | visual effect | visual effect | 0.001-0.01 |
| Total | | | | 100.00 |
| pH | | | | pH 9.5-10.5 |
| Liquid Load (%) | | | | 3.00 |

Example 10

Bathroom Tablet size—6.5 g

TABLE 10

| Ingredients | % | Weight (grams) |
|---|---|---|
| Effervescent Ingredients | 45-55% | 3.00-3.60 g |
| Preservatives | 20-30% | 1.50-2.00 g |
| Surfactant, Binder, Lubricant, etc | 15-25% | 1.00-1.60 g |

Example 11

A low pH bathroom cleanser tablet was produced, using the following ingredients:

TABLE 11

| Raw Materials | Chemistry | Function in tablet | Function in final dilution | Weight (%) |
|---|---|---|---|---|
| Citric Acid | Citric Acid | Acid for effervescent | Acidic Cleaner | 30-40 |
| Sodium Carbonate | Sodium Carbonate | Base for effervescent | Cleaner/pH control | 10-20 |
| Sodium Benzoate | Sodium Benzoate | Preservative | Preservative | 10-30 |
| Sodium lauryl Sulfate | Sodium Lauryl Sulfate | Anionic Surfactant | cleaner | 2-15 |
| Gluconolactone | Gluconolactone | Preservative booster | Preservative booster | 0-10 |
| Potassium Sorbate | Potassium Sorbate | preservative booaster | preservative booaster | 5-15 |
| Sorbitol | Sorbitol | binder | | 0-5 |
| PEG 8000 | Polyethylene Glycol 8000 | Binder | solvent | 0-5 |
| L-leucine | L-leucine | lubricant | | 0-3 |
| Sipernat 50/PPG Hi-Sil ABS Silica | Silicon dioxide | Flow aid | | 0-3.0 |
| Fragrance *Eucalyptus* Mint Contcentrated MOD | Fragrance | scent | | 0-3.0 |
| Bio-Soft N91-8 | Alcohol Ethoxylate C9-C11 8EO | emulsifier | | 0-2 |
| Medium-chain triglycerides Oil | Medium-chain triglycerides Oil | Process aid | | 0-2 |
| Liquitint Bright Yellow | polymeric dye | colorant | | 0-0.1 |
| pH | | | | pH 4.0-5.0 |

Example 12

A foaming hand soap tablet was produced, using the following ingredients:

TABLE 12

| Raw Materials | Chemistry | Function in tablet | Function in final dilution | Weight (%) |
|---|---|---|---|---|
| Citric Acid | Citric Acid | Acid for effervescent | pH control | 20-30% |
| Sodium Carbonate | Sodium Carbonate Dense | Base for effervescent | Cleaner/pH control | 10-25% |
| Sodium Lauryl Sulfate | Sodium Lauryl Sulfate | Anionic Surfactant | Soil remover | 5-25% |
| BASF Lutensol AT 25 | ethoxylated alcohols | Nonionic | oily soil remover | 5-15% |
| PEG 8000 | Polyethylene Glycol 8000 | Binder | solvent | <5% |
| Fragrance | n/a | sensorial effect | sensorial effect | 1-3% |
| Dye/colorant | FD&C or polymetric dye | visual effect | visual effect | 0.001-0.01 |
| Total | | | | 100 |
| pH | | | | pH 4.0-6.0 |
| Liquid Load (%) | | | | 3 |

Example 13

A foaming hand soap tablet was produced, using the following ingredients:

TABLE 13

| Raw Materials | Chemistry | Function in tablet | Function in final dilution | Weight (%) |
|---|---|---|---|---|
| Citric Acid | Citric Acid | Acid for effervescent | pH control | 25-35 |
| Sodium Coco Sulfate | Sodium Coco Sulfate | Surfactant | oily soil remover | 10-25 |
| Sodium Carbonate | Sodium Carbonate Dense | Base for effervescent | Cleaner/pH control | 10-20 |
| Sodium Benzoate | Sodium Benzoate | Lubricating/ Preservative | Preservative | 10-30 |
| Sodium Alginate (Alginate SS207) | Sodium Alginate ( | Thickening Agent | emollient | 1-10 |
| PEG 8000 | Polyethylene Glycol 8000 | Binder | solvent | 0-20 |
| Sorbitol Crystalline P20 | Sorbitol | Binder | solvent | 0-10 |
| Potassium Sorbate | Potassium Sorbate | preservative booster | Preservative | 1-10 |
| Fragrance Clean Basil | Fragrance Clean Basil | sensorial effect | sensorial effect | 0-2 |
| Medium-chain triglycerides Oil | Medium-chain triglycerides Oil | Process aid/ emollient | emollient | 0.2-0.6 |
| Total | | | | 100.00 |
| pH | | | 4.0-6.0 when dissolved in water | |

Example 14

A foaming hand dish soap is produced, using the following ingredients:

TABLE 14

| Ingredients | Function | Weight (%) |
|---|---|---|
| Sodium Bicarbonate | Filler/cleaning agent | Fill to 100% |
| Hydrated silica | Liquid ingredient carrier/flow aid | <1 |
| Fragrance | Scent | 1-3 |
| Surfactant A | Cleaning agent | 1-60 |
| Surfactant B | Cleaning agent | 1-60 |

TABLE 14-continued

| Ingredients | Function | Weight (%) |
|---|---|---|
| Surfactant C | Cleaning agent | 1-60 |
| Surfactant D | Cleaning agent | 1-60 |
| Surfactant E | Cleaning agent | 1-60 |
| Sodium citrate | Water softner | 0-40 |
| Sodium CMC | Foam stabilizer | 0-5 |
| pH | 7.0-9.0 | |

Example 15

Another foaming hand dish soap is produced, using the following ingredients:

TABLE 15

| Ingredients | Function | Weight (%) |
|---|---|---|
| Sodium Bicarbonate | Filler/cleaning agent | Fill to 100% |
| Sodium Lauryl Sulfate | Cleaning agent | 5-15% |
| Sodium Methyl Oleoyl Taurate | Cleaning agent | 2-8% |
| Sodium Citrate | Water softening agent | 2-8% |
| Alky Polyglucoside Surfactants | Porcesses Aid/Cleaning Agent | 0-1.0% |
| Hydrated silica | Liquid ingredient carrier/flow aid | <1 |

Example 16

A dish soap for dish washer is produced, using the following ingredients:

TABLE 16

| Ingredients | Weight (%) | Function |
|---|---|---|
| Sodium Carbonate | 35-43 | filler/cleaning agent |
| Sodium Citrate (Dihydrate) | 17-23 | Water softening agent |
| Citric Acid Anhydrous | 8-12 | Water softening agent |
| Sodium Silicate | 3-5 | filler/pH riser/anti-corrosion inhibitor |
| Subtilisin (Protease) | 2-4 | enzymes |
| Sodium Carboxymethyl Inulin | 2-4 | Anti-filming agent |
| Sorbitan Caprylate | 2-4 | Non-streaking mild cleaner |
| Lauryl/Myristyl Glucoside | 1-4 | Non-ionic surfactant |
| Amylase | 1-3 | enzymes |
| Sorbitol | 0.5-2 | filler |
| Hydrated Silica | <1 | Flow aid |

Example 17

A laundry detergent tablet was produced, using the following ingredients:

TABLE 17

| Ingredients | Weight (%) |
|---|---|
| Sodium Carbonate Dense | 40-50 |
| Citric Acid | 15-25 |
| Protease | 6-12 |
| Alcohols C12-C14 Ethoxylated | 3-9 |
| Sodium Silicate | 2-6 |
| Microcrystalline Cellulose | 1-5 |
| Sodium Starch Glycolate | 1-5 |
| Amylase | 1-5 |
| Mannanase | 1-3 |
| Pectate Lyase | 1-3 |
| Lauryl/Myristyl Glucoside | 1-3 |
| Hydrated Silica | <1 |
| Cellulase | 0.2-0.6 |
| pH | 7.0-9.0 |
| Tablet size | 6.2-6.8 g |

Methods of Using Anhydrous Tablets

In one aspect, disclosed is a method of using some of the tablets described herein including the steps of (1) filling a spray bottle or vessel with volume of 16-34 oz with water, (2) adding the tablet to the water-filled spray bottle, and (3) dissolving the tablet in water by no stirring or shaking required. In some embodiments, one or more tablets may be added to the water-filled spray bottle. For example, two tablets may be added to the spray bottle simultaneously or in a row before ultimately using the liquid solution for its purpose.

Each individual tablet, when exposed to water and stirred or shaken, will dissolve into a liquid solution. Upon experiencing dissolution of the tablet, the user may proceed with cleaning or washing as usual. Individual tablets may be packaged together in suitable bulk quantities.

In one aspect, disclosed is a method of using any of the dish soap described herein including the steps of (1) wetting a sponge/rag or the dish surface with water, (2) placing the dish soap onto the sponge/rag or the dish surface, (3) scrubbing the dish surface with the sponge or let the dish soak (when the dish soap is placed on the dish surface idrectly), and (4) rinsing the dish with water. For the ease of use, the dish soap in a powder form can be placed in a container that is convenient to dispense the dish soap, such as a salt shaker type, an auto dose, spout for powder or flip top.

In one aspect, disclosed is a method of using any of the laundry tablets described herein including the steps of (1) placing the tablet in a container of a washing machine wherein the container is reserved for detergent and (2) turning on the power for the washing machine.

The tablets may be stored in any suitable container, such as but not limited to plastic, glass, aluminum, ceramic, or acrylic container. The container may contain a desiccant. The container may be re-usable and refilled with new tablets as needed.

While some exemplary implementations have been illustrated and described, numerous modifications come to mind without significantly departing from the spirit of the disclosure, and the scope of protection is only limited by the scope of the accompanying claims. Terms such as "top," "bottom," "front," "rear," "upper," "lower," and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference. Furthermore, to the extent that the term "include," "have," or the like is used in the description or the claims, such term is intended to be inclusive in a manner similar to the term "comprise" as "comprise" is interpreted when employed as a transitional word in a claim.

The word "exemplary" is used herein to mean "serving as an example, instance, or illustration." Any embodiment described herein as "exemplary" is not necessarily to be construed as preferred or advantageous over other embodiments. Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A reference to an element in the singular is not intended to mean "one and only one" unless specifically stated, but rather "one or more." Pronouns in the masculine (e.g., his) include the feminine and neuter gender (e.g., her and its) and vice versa. The term "some" refers to one or more. Underlined and/or italicized headings and subheadings are used for convenience only, do not limit the subject technology, and are not referred to in connection with the interpretation of the description of the subject technology. Relational terms such as first and second and the like may be used to distinguish one entity or action from another without necessarily requiring or implying any actual such relationship or order between such entities or actions. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

While this specification contains many specifics, these should not be construed as limitations on the scope of what may be claimed, but rather as descriptions of particular implementations of the subject matter. Certain features and steps that are described in this specification in the context of separate embodiments can also be implemented in combination in a single embodiment. Conversely, various features that are described in the context of a single embodiment can also be implemented in multiple embodiments separately or in any suitable subcombination. Moreover, although features and steps may be described above as acting in certain combinations and even initially claimed as such, one or more features and steps from a claimed combination can in some cases be excised from the combination, and the claimed combination may be directed to a subcombination or variation of a subcombination.

The subject matter of this specification has been described in terms of particular aspects, but other aspects can be implemented and are within the scope of the following claims. For example, while operations are depicted in the drawings in a particular order, this should not be understood as requiring that such operations be performed in the particular order shown or in sequential order, or that all illustrated operations be performed, to achieve desirable results. The actions recited in the claims can be performed in a different order and still achieve desirable results. As one example, the processes depicted in the accompanying figures do not necessarily require the particular order shown, or sequential order, to achieve desirable results. In certain circumstances, multitasking and parallel processing may be advantageous. Moreover, the separation of various system components in the aspects described above should not be understood as requiring such separation in all aspects, and it should be understood that the described program components and systems can generally be integrated together in a single product or packaged into multiple products.

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

The disclosed systems and methods are well adapted to attain the ends and advantages mentioned as well as those that are inherent therein. The particular implementations disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative implementations disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each article of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The invention claimed is:

1. A method of producing an anhydrous tablet, the anhydrous tablet comprising an acidic cleaner, a basic cleaner, and a surfactant; the method comprising the steps of:

providing medium-chain triglyceride (MCT) oil;

adding the MCT oil to an acidic cleaner, a basic cleaner powder and a surfactant powder;

absorbing the MCT oil into the acidic cleaner, the basic cleaner powder and the surfactant powder to produce a powder blend;

placing the powder blend in a tablet press;

applying pressure to the powder blend in the tablet press;

removing at least a portion of the MCT oil from the powder blend in the tablet press;

using the portion of the MCT oil removed from the powder blend to create a hydrophobic layer on at least a portion of the exterior of the powder blend;

removing pressure applied to the powder blend by the tablet press;

producing an anhydrous tablet from the pressed powder blend;

wherein MCT oil is caprylic capric triglyceride.

2. The method of claim 1, further comprising the step of adding one or more additional ingredients selected from the group comprising fragrance, emulsifier, and dye to the powder blend after the MCT oil is absorbed into the acidic cleaner, the basic cleaner powder and the surfactant powder.

3. The method of claim 1, wherein the at least a portion of the MCT oil removed from the powder blend in the tablet press is removed by the pressure applied by the tablet press to the powder blend.

4. The method of claim 1, wherein the powder blend is not stuck to the tablet press after pressure is removed from the powder blend.

5. The method of claim 4, wherein the hydrophobic layer prevents the powder blend from sticking to the tablet press.

6. The method of claim 1, wherein the concentration of MCT oil is 0.05-1.00 wt %.

7. The method of claim 1, further comprising the step of adding fragrance to the powder blend.

8. The method of claim 1, further comprising the steps of adding the MCT oil to a silica powder and absorbing the MCT oil into the silica powder.

9. The method of claim 1, wherein the MCT oil comprises fragrance, emulsifier, and/or dye.

10. The method of claim 1, wherein at least 70 kN of force is applied to the powder blend by the tablet press.

11. The method of claim 1, wherein each linear dimension of the tablet is smaller than 28 millimeters.

12. The method of claim 1, wherein each linear dimension of the tablet is less than 0.75 inches.

13. The method of claim 1, wherein the ingredients of the tablet are not granulated prior to tablet production.

14. The method of claim 1, wherein the basic cleaner is selected from sodium carbonate, sodium bicarbonate and other alkali carbonates.

* * * * *